US009591928B2

(12) United States Patent
Martinez

(10) Patent No.: US 9,591,928 B2
(45) Date of Patent: Mar. 14, 2017

(54) MOTORIZED CONVERTIBLE SOFA OF THE PERPENDICULAR-SLEEPING TYPE

(71) Applicant: Jose Martinez, Cuges-les-Pins (FR)

(72) Inventor: Jose Martinez, Cuges-les-Pins (FR)

( * ) Notice: Subject to any disclaimer, the term of this patent is extended or adjusted under 35 U.S.C. 154(b) by 26 days.

(21) Appl. No.: 14/195,957

(22) Filed: Mar. 4, 2014

(65) Prior Publication Data

US 2015/0150382 A1 Jun. 4, 2015

(30) Foreign Application Priority Data

Dec. 4, 2013 (FR) ..... 13 02824

(51) Int. Cl.
*A47C 17/17* (2006.01)
*A47C 17/16* (2006.01)

(52) U.S. Cl.
CPC ..... *A47C 17/17* (2013.01); *A47C 17/161* (2013.01)

(58) Field of Classification Search
CPC ..... A47C 17/17; A47C 17/161; A47C 17/16; A47C 17/175; A47C 17/1753; A47C 17/1756
See application file for complete search history.

(56) References Cited

U.S. PATENT DOCUMENTS 2,210,421 A * 8/1940 Martin ..... 5/38
2,257,753 A * 10/1941 Martin ..... 5/38
2,257,754 A * 10/1941 Martin ..... 5/38
2,562,197 A * 7/1951 Martin ..... 5/38
4,365,369 A * 12/1982 Plume ..... 5/38
4,402,096 A * 9/1983 Atimichuk ..... 5/17
4,608,722 A * 9/1986 Zorzetto ..... 5/18.1
4,625,346 A * 12/1986 Quackenbush ..... 5/37.1
4,628,551 A * 12/1986 Atimichuk ..... 5/12.1
4,660,235 A * 4/1987 Plume ..... 5/38
5,327,591 A * 7/1994 Fireman et al. ..... 5/47
5,913,770 A * 6/1999 Tseng ..... 5/37.1
6,138,299 A * 10/2000 Roma ..... A47C 17/1753 5/37.1
6,739,651 B1 * 5/2004 Barefoot ..... 297/118
2008/0092290 A1 * 4/2008 Cabrera et al. ..... 5/47
2011/0258773 A1 * 10/2011 Contreras et al. ..... 5/13
2011/0277233 A1 * 11/2011 Beck et al. ..... 5/13
2012/0047647 A1 * 3/2012 Steers et al. ..... 5/13

FOREIGN PATENT DOCUMENTS

FR 2614773 A1 * 11/1988 ..... A47C 17/16

* cited by examiner

*Primary Examiner* — Nicholas Polito
*Assistant Examiner* — Eric Kurilla
(74) *Attorney, Agent, or Firm* — Anderson Gorecki LLP

(57) ABSTRACT

A convertible sofa of the perpendicular-sleeping type, comprising a fixed structure supporting a foldable structure which comprises three articulated panels and a system of actuation of folding/unfolding of the foldable structure between a sofa configuration and a sleeping configuration and vice versa, which comprises at least one motorized actuator comprising a body within which a rod is movable in translation, where the body is mounted on one of either the fixed or foldable structure and the end of the rod is articulated on the other of the fixed or foldable structure, the movement of the rod causing the foldable structure to fold/unfold.

10 Claims, 4 Drawing Sheets

MOTORIZED CONVERTIBLE SOFA OF THE PERPENDICULAR-SLEEPING TYPE

CROSS REFERENCE TO RELATED APPLICATIONS

The present application claims the benefit of French Patent Application No. 13/02824 filed on Dec. 4, 2013, which is incorporated herein by reference in its entirety.

BACKGROUND

The present invention relates to a convertible sofa of a perpendicular-sleeping type.

In a manner known in the field of furniture and in particular in the field of convertible sofas, a perpendicular-sleeping convertible sofa is also called a convertible sofa/couch or sofa bed of the "BZ" type.

Such a sofa conventionally comprises a fixed structure supporting a foldable structure, which comprises three panels, namely a central panel having two opposite sides respectively articulated on a front panel and a rear panel along parallel joint axes, where the foldable structure is movable in a folded/unfolded (usually called "accordion") state between: —a sofa configuration in which the front panel forms a seat, the central panel forms a backrest, and the rear panel is folded over the central panel; and—a sleeping configuration in which the three panels are substantially coplanar so as to form a bed base.

However, the folding/unfolding operations often prove to be tedious when done manually, whence the development of motorized sofas incorporating a system of actuation of the folding/unfolding of the foldable structure between the sofa configuration and the sleeping configuration, and vice versa.

The document FR 2 743 275 describes a motorized sofa in which the system of actuation comprises a rotary motor that rotationally drives a pinion cooperating with a link chain, a free end of which is coupled to the front panel. Such a solution is, however, unsuitable for home use, because the system with the pinion and chain is a source of noise, with occasional leakage of the lubricant needed for proper engagement between the pinion and the chain, not to mention the complexity and costs incurred by the chain, which needs to measure at least 1.50 m.

The document DE 935 275 likewise describes a motorized sofa in which the system of actuation comprises a rotary motor that rotationally drives a pinion, via a transmission belt, where the pinion is in meshed engagement with a sector gear mounted onto the rear panel. This belt, pinion, and sector gear system suffers from the same drawbacks as those of the sofa in FR 2 743 275, namely the noise, the lubricant leakage, the complexity, and the cost.

The document FR 2 614 773 discloses another motorized sofa in which the system of actuation comprises an electric winch that winds and unwinds cables fixed to the front and rear ends of the front panel. This winch and cable system suffers from several drawbacks in terms of noise, safety, and cost, not to mention the complexity of managing the windings of the cables.

SUMMARY

An objective of the present invention is to entirely or partially resolve these drawbacks by proposing a convertible sofa of a perpendicular-sleeping type that is equipped with a system of actuation of simple design and low cost, that can be used quietly and without lubricant leakage.

To that end, the invention relates to a convertible sofa of the perpendicular-sleeping type, said sofa comprising a fixed structure supporting a foldable structure which comprises three panels, namely, a central panel having two opposite sides respectively articulated on a front panel and a rear panel along axes of articulation parallel to a transverse direction, where the foldable structure can be moved folding/unfolding along a longitudinal direction between: —a sofa configuration in which the front panel forms a seat, the central panel forms a backrest, and the rear panel is folded over the central panel; and—a sleeping configuration in which the three panels are substantially coplanar so as to form a bed base; said sofa further comprising a system of actuation of folding/unfolding of the foldable structure between the sofa configuration and the sleeping configuration, and vice versa; said sofa being remarkable in that the system of actuation comprises at least a motorized actuator comprising a body within which a rod is movable in translation, where the body is articulated on one of either the fixed or foldable structure and the end of the rod is articulated on the other of the fixed or foldable structure, the movement of the rod causing the foldable structure to fold/unfold.

Thus, the invention proposes motorizing the sofa by means of a motorized actuator that ensures folding/unfolding that is motorized and therefore does not require user effort, the motorized actuator being advantageously controllable by means of a wired or wireless remote control.

In an advantageous embodiment, the sofa further comprises means of support for the foldable structure on the fixed structure, said means of support ensuring support of the foldable structure on the fixed structure in the sofa configuration, and said means of support being shaped so as to maintain a sliding or rolling support between the foldable structure and the fixed structure in the longitudinal structure along at least the longitudinal element of the fixed structure and/or of the foldable structure, so as, on one hand, to maintain the support of the foldable structure on the fixed structure during a part of the folding/unfolding, and on the other hand to guide the foldable structure from the sleeping configuration to the sofa configuration.

The means of support thus have a dual function, the first function being to stabilize the sofa on the ground, and more specifically to immobilize same on the ground during the movements of folding/unfolding, owing to the support of the foldable structure on the fixed structure at the departure from the sofa configuration (in the direction of unfolding) or at the arrival to the sofa configuration (in the direction of folding). Indeed, these two positions of departure and arrival can be critical in terms of weight transfer, because the actuator can move the fixed structure (when not anchored or weighted to the ground) just as well as the foldable structure. The means of support are designed to ensure that the folding structure supports the fixed structure, while following the folding or unfolding movement (owing to the rolling or sliding support) and therefore maintains the fixed structure in place on the ground. Thus, the actuator moves only the foldable structure, with the fixed structure being immobilized owing to the means of support.

The second function is to guide the foldable structure, essentially at the departure from the sofa configuration (in the direction of unfolding). Indeed, being that the unfolding is motorized and no one pulls on the structure (as would be the case with a non-motorized convertible sofa), it is important that the front panel be driven or guided in longitudinal translation toward the front, and, owing to the rolling or sliding means of support, guidance in longitudinal translation is achieved so as merely to allow this guidance.

In other words, during the actuation of the actuator, the rod of the actuator moves the foldable structure along a folding/unfolding movement, and thus the rod and the body of the actuator are subjected to the reaction of the foldable structure (weight, resistance at the articulations and during weight transfer between the panels), at the risk of moving the fixed structure on the ground. The means of support therefore make it possible to transfer the weight of the panels in movement on the fixed support, thus ensuring the pressing and immobilization of the fixed support on the ground; the sliding or rolling support of the support piece or support pieces guaranteeing a continued support during the movement of the panels and therefore the above-mentioned guidance.

According to one feature, the means of support comprises: at least one sliding or rolling support piece sliding mounted onto one of either the fixed or foldable structure; and at least one longitudinal element integrated to the other of the fixed or foldable structure, extending along the longitudinal direction and defining a surface of contact with the support piece or support pieces, the contact being maintained over a predetermined length along said longitudinal element.

Thus, the sliding or rolling support is achieved by means of the support piece(s), on at least one longitudinal element defining a longitudinally extending surface of contact in order for the support to be maintained over a certain length in the critical periods, at the departure from the sofa configuration (in the direction of unfolding) and the arrival to the sofa configuration (in the direction of folding).

According to another feature, the means is distributed symmetrically along a median and longitudinal plane of the sofa, said means of support comprising: at least one right support piece mounted onto one of the fixed or foldable structures and cooperating with at least one right longitudinal element integrated to the other of the fixed or foldable structures; and at least one left support piece mounted onto one of the fixed or foldable structures and cooperating with at least one left longitudinal element integrated to the other of the fixed or foldable structures.

In this manner, the supports achieved by the support pieces are distributed between the right and left, thus balancing the weight transfer of the panels on the fixed support and the guidance of the foldable structure in the aforementioned critical periods.

According to another feature, the means of support are distributed between the front and rear and comprise: at least one front support piece mounted onto one of the fixed or foldable structures and cooperating with a front surface of contact integrated to the other of the fixed or foldable structures; at least one rear support piece mounted onto one of the fixed or foldable structures and cooperating with a rear surface of contact integrated to the other of the fixed or foldable structures; where said front and rear support pieces are offset from each other in the longitudinal direction.

Thus, the front and rear support pieces slide or roll over almost the entire length of the longitudinal element (of the fixed structure or of the foldable structure), thus making it possible to maintain the weight transfer of the panels for sufficiently long enough to effectively immobilize the fixed support in the aforementioned critical periods. The front and rear support pieces also guarantee that the weight transfer and guidance of the foldable structure are maintained; even when one of the support pieces loses contact with the surface of contact, the other support piece would maintain contact in order to ensure the weight transfer and guidance.

Advantageously, the front and rear support pieces are also offset from one another in the transverse direction, and the front and rear surfaces of contact are also offset from one another in the transverse direction, the advantage of such offsetting being to offer distinct surfaces of contact and distinct profiles useful for guidance of the foldable structure.

According to another feature, the means of support are configured so as, in the sofa configuration, to lift a front side of the front panel, opposite to a rear side articulated on the central panel, in order for said front panel to be inclined with respect to the horizontal, and to lock said sofa into the lifted configuration.

Thus, the means of support ensures that in the sofa configuration, the front of the seat (the front panel) is lifted such that the seat is slightly inclined with respect to the horizontal, for the sake of the comfort of the seat, and also the stability and maintenance of the sofa in this configuration. Moreover, this lifted configuration (i.e., with lifted seat) is mechanically locked or blocked, in conjunction with the blockage intrinsically achieved by the actuator, in the obvious interest of mechanical strength.

According to another feature, the front support piece or support pieces have dimensions in a vertical direction orthogonal to the transverse and longitudinal directions that are greater than those of the rear support piece or support pieces, and the front surface or surfaces of contact have a locking ramp on which the relevant front support piece is supported in the sofa configuration, so as to ensure the locking of the sofa in this lifted configuration.

By way of example, when the support piece or support pieces are wheels, the front wheels are of a greater diameter than the rear wheels, so as to lift the front of the seat in the sofa configuration.

Moreover, the locking ramp mechanically blocks the sofa in the sofa configuration, because the corresponding front support piece would have to go back up the ramp in order for the sofa to come out of this sofa configuration, something that is mechanically impossible with the seat lifted and with the actuator off.

According to another feature, the front surface or surfaces of contact have a plate longitudinally extended on one side by the locking ramp and on the other side by a guidance ramp designed so as to guide the relevant front support piece during the folding from the sleeping configuration to the sofa configuration.

The guidance ramp or ramps thus make it possible to guide the front pieces toward the boards, for continuity in the movements of the panels, unencumbered, before rolling over the locking ramp.

According to another feature, the support piece or support pieces comprise a wheel rotatably mounted about an axis parallel to the axes of articulation.

According to another feature, the means of support constitutes a means of support of the front panel of the foldable structure on the fixed structure.

In other words, the means of support ensure the rolling or sliding support of the front panel of the fixed structure during the aforementioned critical periods, given that the front panel is essentially guided in translation during the folding/unfolding movements, which facilitates achieving the rolling or sliding longitudinal support or supports between the front panel and the fixed structure.

Thus, according to one feature, the means of support comprises: at least one sliding or rolling support piece mounted onto the front panel or onto the fixed structure; and at least one longitudinal element integrated conversely on the fixed structure or on the front panel.

Alternatively, the means of support constitutes a means of support of the central panel of the foldable structure on the fixed structure.

This variation is, however, more complex, because the central panel is moved in a complex movement combining translation and rotation, such that the surface or surfaces of contact must have a complex profile to ensure the support and guidance of the central panel on the fixed structure.

According to another feature, the rear panel is articulated on the fixed structure along an axis of articulation parallel to the axes of articulation, and the body of the actuator is articulated on the fixed structure or on the rear panel, and the end of the rod is articulated conversely on the rear panel or on the fixed structure.

Thus, the actuator acts on the rear panel to control the folding/unfolding movements of the foldable structure. The rotation of the rear panel, controlled by the actuator, is therefore what is at the origin of all the folding/unfolding movements of the sofa. The means of support thus proves to be particularly important in this case, because the folding/unfolding movement starts from the rear, and the means of support will make it possible to drive/guide the front panel in translation toward the front (during unfolding), which is practical because the front panel advances only by virtue of being pushed by the central panel at the shared articulation thereof (the means of support avoiding precisely a blockage at this articulation between the rear panel and central panel).

According to another feature, the rear panel comprises a frame, and the articulation of the rod or of the body of the actuator on the rear panel is achieved by a lever arm secured to the frame of the rear panel.

According to another feature, the foldable structure is wider (in the transverse direction) than the fixed structure, such that the support pieces (the surfaces of contact, respectively) are located on the inside of the foldable structure whereas, conversely, the surfaces of contact (the support pieces, respectively) are located on the fixed structure, and in particular on the outside of the fixed structure and/or on top of the fixed structure.

By way of example, the support pieces are mounted on the inside of the foldable structure (in particular, on the inside of the front panel) in order to cooperate with the surfaces of contact provided on the fixed structure.

Alternatively, the foldable structure is less wide (in the transverse direction) than the fixed structure, such that the support pieces (the surfaces of contact, respectively) are located on the outside of the foldable structure whereas, conversely, the surfaces of contact (the support pieces, respectively) are located on the fixed structure, and in particular on the inside of the fixed structure and/or on top of the fixed structure.

This variation corresponds in particular to a situation where the fixed structure is composed of two lateral armrests, preferably connected by a transverse bar.

By way of example, the support pieces are mounted on the outside of the foldable structure (in particular, on the outside of the front panel) in order to cooperate with the surfaces of contact provided on the inside of the fixed structure.

Note that each of the different features, techniques, configurations, etc. discussed in this disclosure can be executed independently or in combination. Accordingly, the present invention can be embodied and viewed in many different ways. Also, note that this summary section herein does not specify every embodiment and/or incrementally novel aspect of the present disclosure or claimed invention. Instead, this summary only provides a preliminary discussion of different embodiments and corresponding points of novelty over conventional techniques. For additional details, elements, and/or possible perspectives (permutations) of the invention, the reader is directed to the Detailed Description section and corresponding figures of the present disclosure as further discussed below.

BRIEF DESCRIPTION OF THE DRAWINGS

The foregoing will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention. The drawings are not necessarily to scale, emphasis instead being placed upon illustrating the principles of the invention.

DETAILED DESCRIPTION

Figure 1:
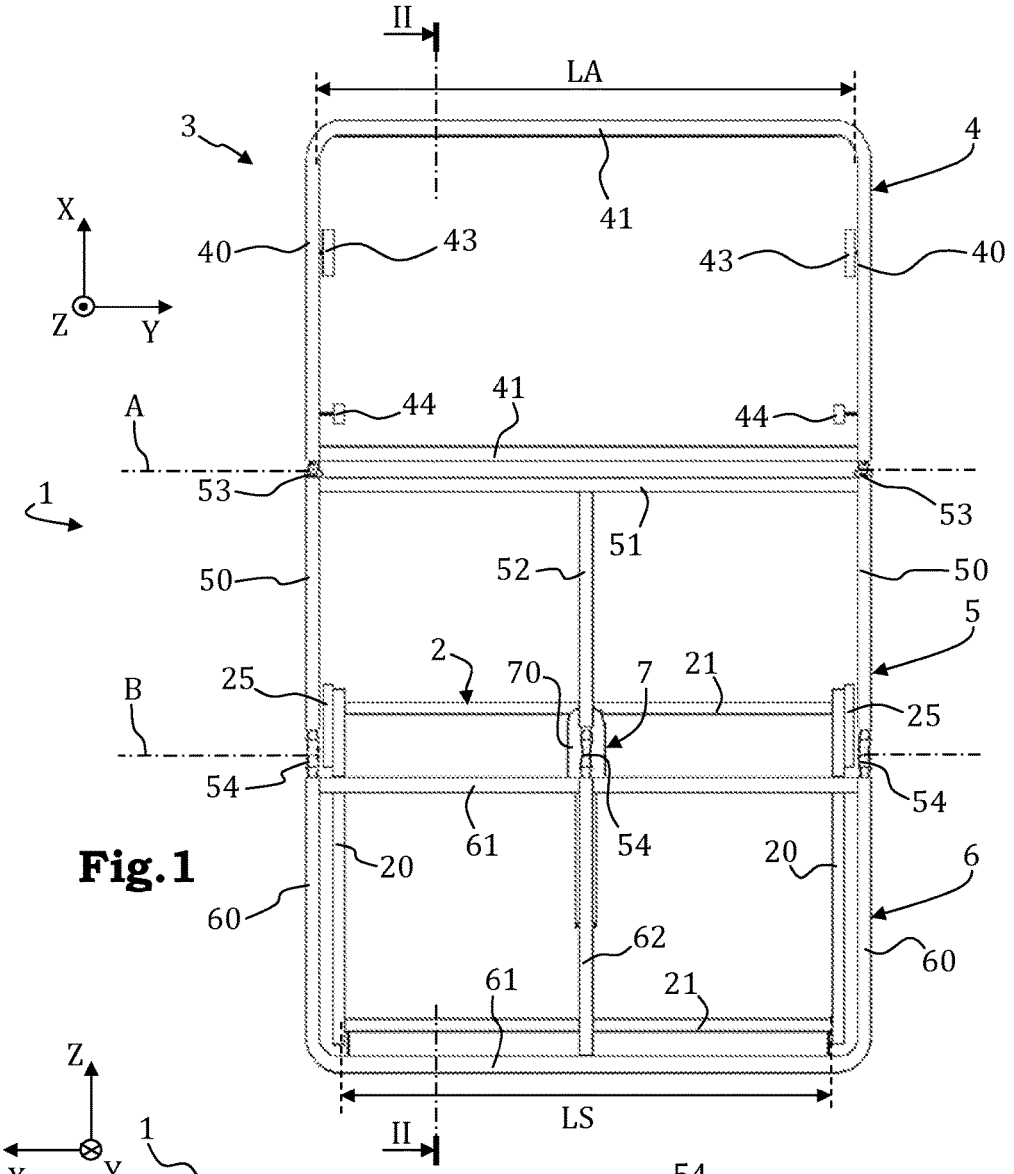
FIG. 1 is a schematic top view of a sofa as in the invention, in the sleeping configuration.

The embodiments set forth below represent the necessary information to enable those skilled in the art to practice the invention and illustrate the best mode of practicing embodiments of the invention. Upon reading the following description in light of the accompanying figures, those skilled in the art will understand the concepts of the invention and recognize applications of these concepts not particularly addressed herein. It should be understood that these concepts and applications fall within the scope of the disclosure and the accompanying claims.

The preferred embodiment of the invention will now be described with reference to the accompanying drawings. The invention may, however, be embodied in many different forms and should not be construed as limited to the embodiment set forth herein; rather, this embodiment is provided so that this disclosure will be thorough and complete, and will fully convey the scope of the invention to those skilled in the art. The terminology used in the detailed description of the particular embodiment illustrated in the accompanying drawings is not intended to be limiting of the invention. In the drawings, like numbers refer to like elements.

The following description handily refers to the references (X, Y, Z), comprising: the longitudinal X-axis defining the longitudinal X-direction extending from the front toward the rear of the sofa, and established according to the greatest length of the bed base (the term "front" referring to the front of the sofa (the seat side) and the term "rear" referring to the rear of the sofa (the backrest side)); the transverse Y-axis defining the transverse Y-direction extending from the right to the left of the sofa, and established according to the width of the sofa from the left to the right, the axes X and Y defining the horizontal plane when the sofa rests on a horizontal ground; and the vertical Z-axis defining the vertical Z-direction extending upwardly from below, and established according to the height of the sofa when the sofa is typically situated, that is to say, resting on a horizontal ground.

With reference to the drawings, a sofa 1 as in the invention comprises a fixed structure 2 which is composed of a frame of an outer width LS (in the Y-direction) provided with: two lateral beams 20, right and left, respectively, extending in the X direction; two transverse beams 21, front and rear, respectively, extending in the Y direction and connecting the two lateral beams 20; and four feet 22 at the front and rear ends of the lateral beams 20.

The lateral beams 20 each have a substantially planar upper surface (the tops of the lateral beams 20), which form contact surfaces.

The fixed structure 2 comprises also two front supports 25, right and left respectively, fixed onto the respective lateral beams 20. Each front support 25 is fixed onto the front end of the corresponding lateral beam 20, and each front support 25 is fixed onto the outer side of the corresponding lateral beam 20, that is to say, opposite to the interior of the frame of the fixed structure. The front supports 25 each have an upper surface, which form contact surfaces.

As illustrated in FIGS. 9*a* to 9*d*, each front support 25 is formed to be a rigid plate, in particular steel, which creates a central, flat board 251 parallel to the upper surface of the corresponding lateral beam 20, the central board 251 being, for example, coplanar with (that is to say, on the same level as) the upper surface of the corresponding lateral beam 20.

For each front support 25, the board 251 is framed by two ramps, respectively a front ramp 250 (or guide ramp) and rear ramp 252 (or lock ramp), which descend relative to the board 251; in other words, the board 251 represents the peak of the ramps 250, 252.

The sofa 1 also comprises a foldable structure 3 comprising articulated panels, namely, a front panel 4, a central panel 5, and a rear panel 6. The central panel 5 has two opposite transverse sides (parallel to the transverse beams 21) respectively articulated on the front panel 4 and on the rear panel 6 along parallel joint axes A, B.

The front panel 4 is formed so as to be a frame of an inner width LA (in the Y-direction), provided with: two lateral beams 40, left and right, respectively, extending in the X direction; and two transverse beams 41, front and rear, respectively, extending in the Y-direction and connecting the two lateral beams 40.

The front panel 4 is also provided with four feet 42, terminating in wheels 420 or sliding pads, the feet being disposed at the front and rear ends of the lateral beams 40 and provided so as to be (rollingly or slidingly) supported by the ground when moving in longitudinal translation toward the front and rear during the phases of unfolding and folding, respectively.

Figure 6:
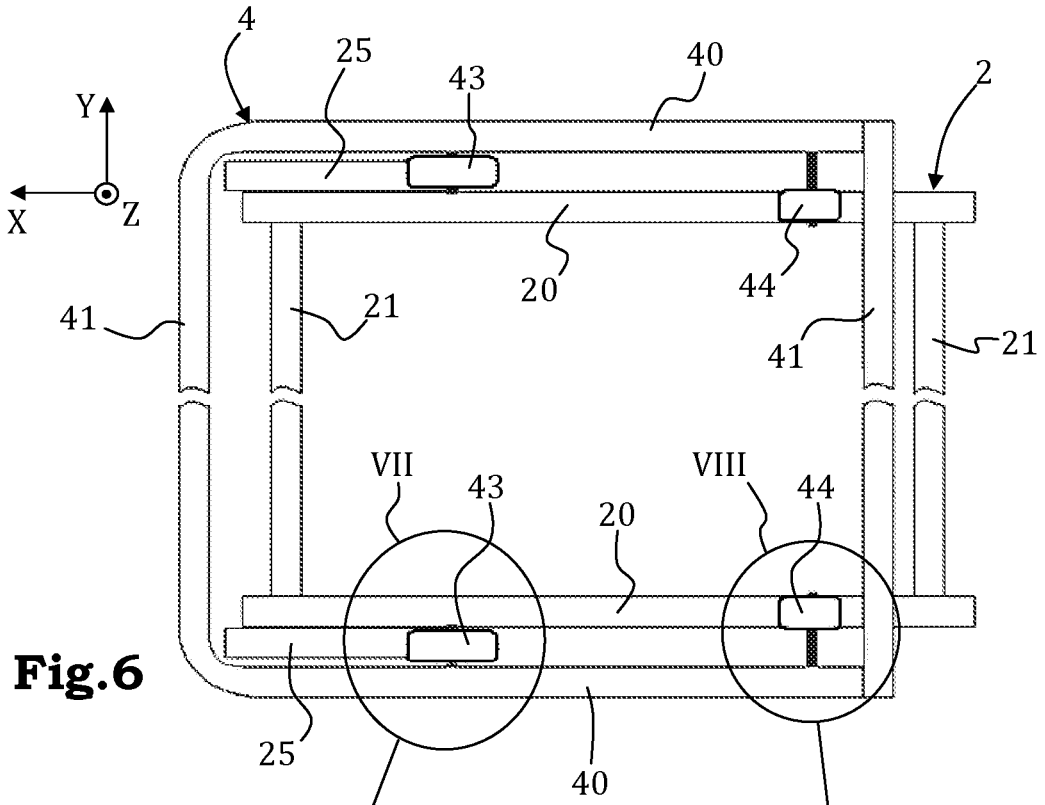
FIG. 6 is a partial schematic top view of the sofa of FIG. 1, in the sofa configuration.
Figure 7:
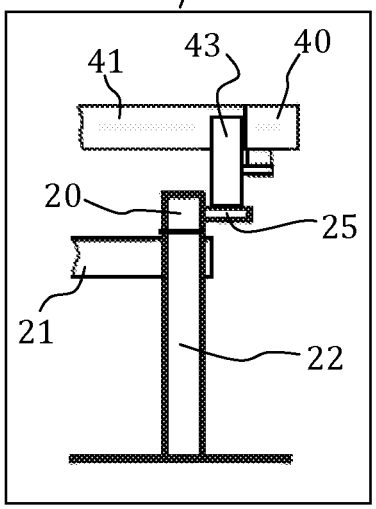
FIG. 7 is a view of the zone VII of FIG. 6, in a transverse cross-sectional plane.
Figure 8:
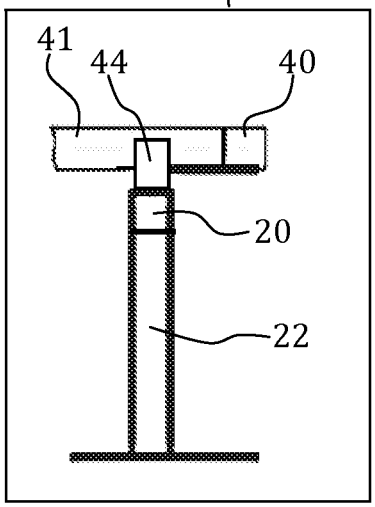
FIG. 8 is a view of the zone VIII of FIG. 6, in a transverse cross-sectional plane.
Figure 9A:
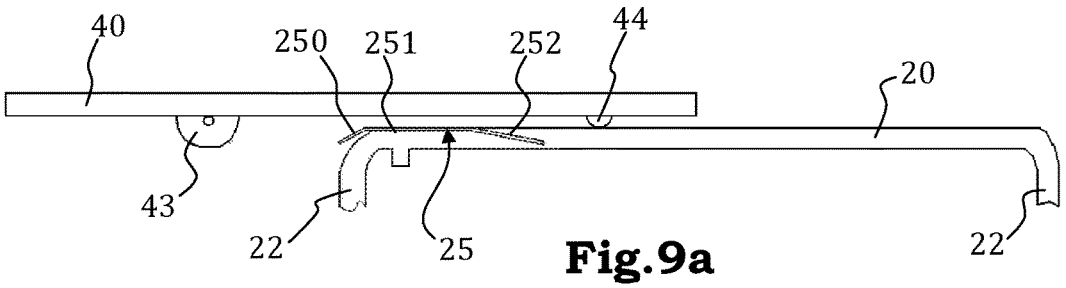
FIGS. 9*a* to 9*d* are schematic side views of a sofa as in the invention, during folding thereof to the sofa configuration (FIG. 9*d*) at a plurality of moments, to illustrate the guidance provided by the front supports.
Figure 9B:
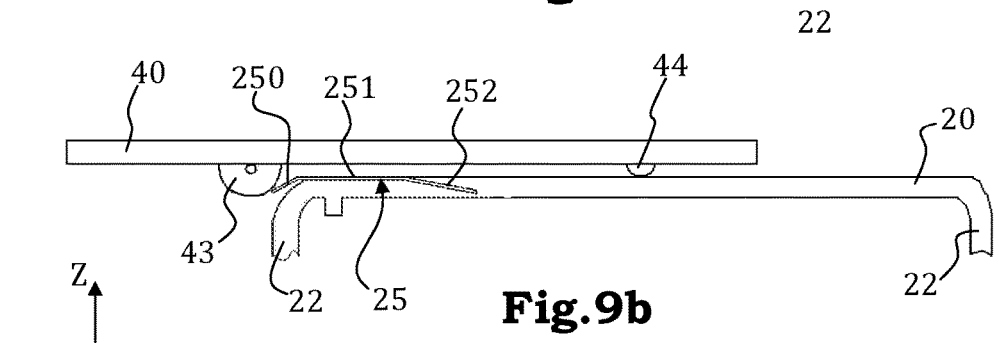
Figure 9C:
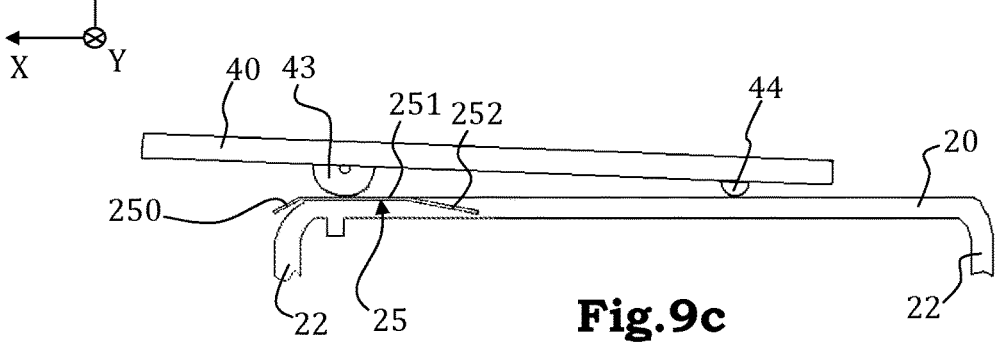
Figure 9D:
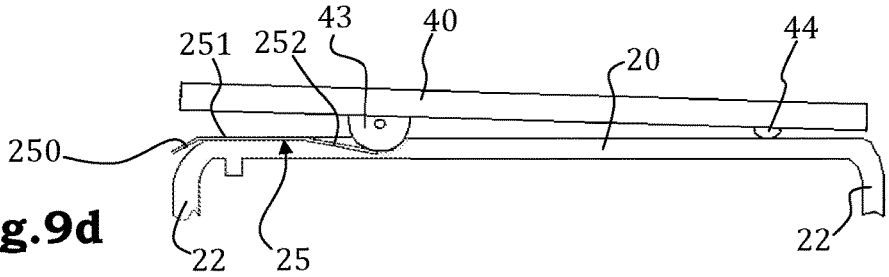

The inner width LA is substantially greater than the outer width LS of the frame of the fixed structure 2 plus twice the width of the front supports 25 (the two supports having the same width). Thus, as illustrated in FIG. 6, the frame of the front panel 4 can come to fit onto the fixed structure 2 (with the mounting kits nearby) in the sofa configuration.

The front panel 4 also incorporates two front wheels 43 and two rear wheels 44, in particular of a roller pad type, which are rotatably mounted onto the lateral beams 40, and more specifically rotatably mounted onto the inner or lower sides of the lateral beams 40, with one front wheel 43 and one rear wheel 44 per lateral beam 40. The right front wheel 43 is mounted onto the lateral beam 40 opposite to (or symmetrically to) the left front wheel 43, which is mounted onto the left lateral beam 40, and the right rear wheel 44 is mounted onto the lateral beam 40 opposite to (or symmetrically to) the left rear wheel 43, which is mounted onto the left lateral beam 40. The wheels 43, 44 do not protrude beyond above the frame of the front panel 4, so as not to interfere with receiving a mattress.

The wheels 43, 44 are directed toward the inside of the frame of the front panel 4, with the rear wheels 44 more shifted in the Y-direction from the respective lateral beams 40 thereof than the front wheels 43; in other words, each of the front wheels 43 is closer to the lateral beam 40 thereof than the rear wheel 44, the front wheel 43 being substantially pressed against the lateral beam 40 (with the near fitting clearance necessary for the front wheel 43 to rotate properly), whereas the rear wheel 44 is offset transversely from the lateral beam 40 at a distance substantially corresponding to the width of the front supports 25.

The rear wheels 44 are located closer to the rear ends of the respective lateral beams 40, whereas the front wheels 43 are located closer to the front ends of the respective lateral beams 40. However, each of the rear wheels 44 is disposed at a predetermined distance from the rear end of the corresponding lateral beam 40, to facilitate the driving forward of the front panel 4 when the foldable structure 3 is being unfolded.

In addition, the front wheels 43 have a larger diameter than that of the rear wheels 44, and the axes of rotation of the front wheels 43 are downwardly shifted with respect to the rear wheels 44. Thus, the front wheels 43 provide rolling support surfaces located beneath with respect to the rolling support surfaces provided by the rear wheels 44.

The central panel 5 is in the form of a frame of an inner width LA, provided with two lateral beams 50, left and right, respectively, extending along the X-axis and connected by a front transverse beam 51 extending along the Y-axis.

The central panel 5 also comprises a central beam 52 parallel to the lateral beams 50. Alternatively, the central panel 5 does not comprise such a central beam 52, but rather comprises a rear transverse beam extending along the Y-axis and connecting the two lateral beams 50.

The front panel 4 is articulated on the central panel 5 along an axis of rotation A (parallel to the Y-axis), by means of two hinges or articulations 53 provided between the rear ends of the lateral beams 40 of the front panel 4 and the front ends of the lateral beams 50 of the central panel 5.

The rear panel 6 is formed so as to be a frame of an inner width LA, provided with: two lateral beams 60, left and right, respectively, extending along the X-axis; two transverse beams 61, front and rear, respectively, extending along the Y-axis and connecting the two lateral beams 60.

Optionally, the rear panel 6 also comprises a central beam 62 parallel to the lateral beams 60 and extending between the two transverse beams 61, or even a plurality of inner beams extending along the Y-axis and connecting the two transverse beams 61.

The front panel 6 is articulated on the central panel 5 along an axis of rotation B (parallel to the Y-axis), by means of two hinges or articulations 54 provided between the front ends of the lateral beams 60 of the rear panel 6 and the rear ends of the lateral beams 50 of the central panel 5.

In the embodiment with the central beams 52, 62, a third hinge or articulation 54 may also be provided between the front end of the central beam 62 and the rear end of the central beam 52.

The rear panel 6 is also articulated on the fixed structure 2 along an axis of rotation C (parallel to the Y-axis). More specifically, the rear panel 6 is articulated on the rear of the fixed structure 2, by means of at least one arm 63 secured to the rear transverse beam 61 of the rear panel 6 and articulated on the fixed structure 2, e.g., on the lateral beams 20.

Preferably, for the sake of stability, the rear panel 6 is articulated onto the fixed structure 2 by means of a plurality of arms 63 secured to the rear transverse beam 61 of the rear panel 6 and articulated onto the fixed structure 2, e.g., on the two lateral beams 20. The arm 63 or plurality of arms 63 each have an end fixed onto the rear transverse beam 61 of the rear panel 6 and an opposite end articulated onto the fixed structure 2.

The sofa 1 also comprises a motorized, electric actuator 7 comprising a body 70 within which a rod 71 is movable in translation.

The body 70 is articulated on the fixed structure 2 along an axis of rotation D (parallel to the Y-axis), and is, for example, positioned in the middle of the sofa 1, so that the body 70 can be articulated on the middle of the front transverse beam 20 of the fixed structure 2. The body 70 is thus positioned on the front of the fixed structure 2, on the front transverse beam 21.

The rod 71 has one end articulated on the rear panel 6 along an axis of rotation E (parallel to the Y-axis), in order to rotatingly move the rear panel 6 about the axis of rotation C, and consequently fold/unfold the foldable structure 3.

More specifically, the rod 71 on the rear panel 6 is articulated on a lever arm 64 secured to the frame of the rear panel 6, and more specifically secured to the rear transverse beam 61. The lever arm 64 has one end secured to the rear transverse beam 61 and an opposite end rotatingly articulated on the end of the rod 71. The lever arm 64 extends substantially at a right angle to the rear transverse beam 61 as well as to the central beam 62. The lever arm 64 is located in the middle of the sofa 1, and is continuous with and at a right angle to the central beam 62.

The following description relates to the operation of the sofa 1.

Figure 2:
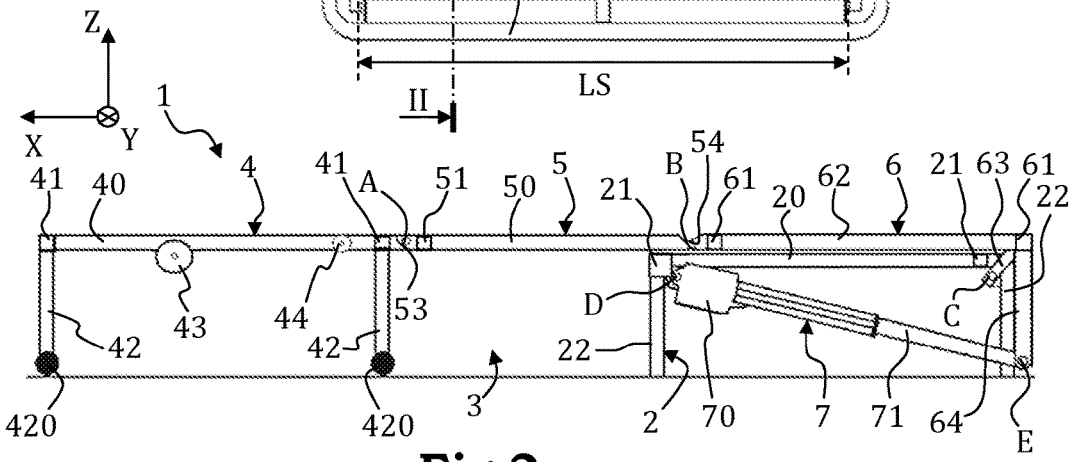
FIG. 2 is a schematic view of the sofa of FIG. 1 in the sleeping configuration, according to the cross-sectional plane II-II.
Figure 3:
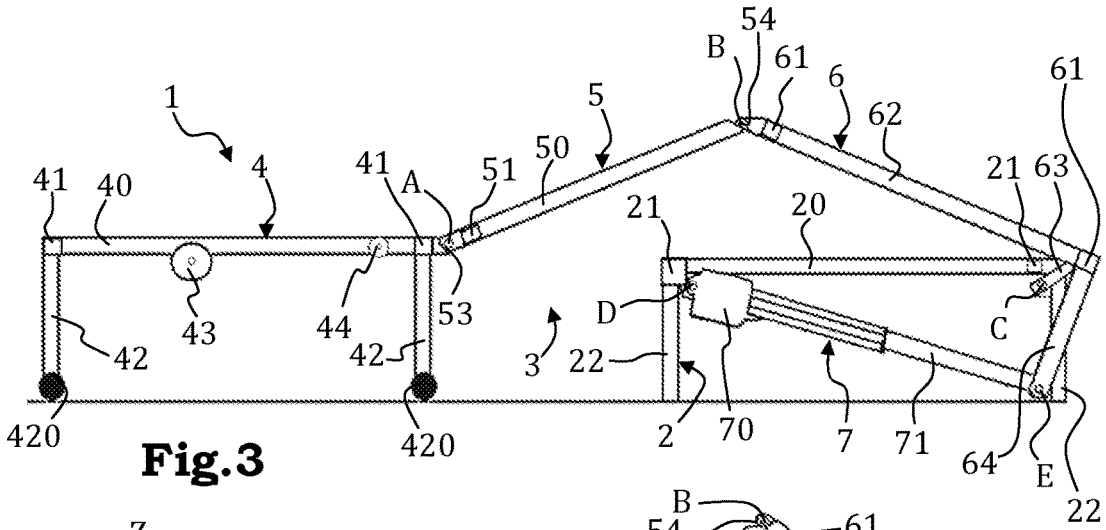
FIG. 3 is a schematic view of the sofa of FIG. 1 in a first intermediate configuration during the folding of the sofa from the sleeping configuration in FIG. 2, in the same lateral cross-sectional plane II-II.
Figure 4:
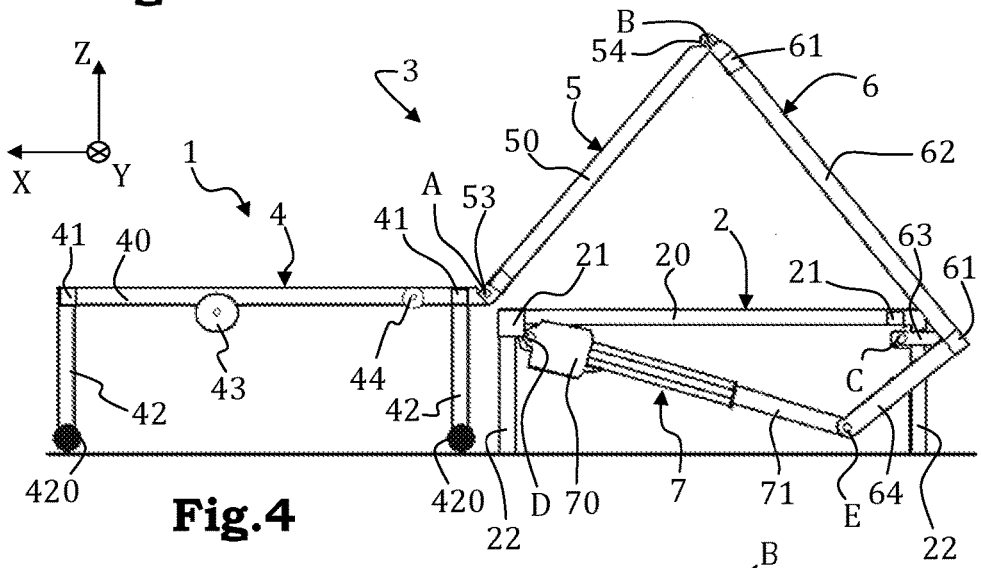
FIG. 4 is a schematic view of the sofa of FIG. 1 in a second intermediate configuration following the first intermediate configuration of FIG. 3, during the folding of the sofa, in the same cross-sectional plane II-II.
Figure 5:
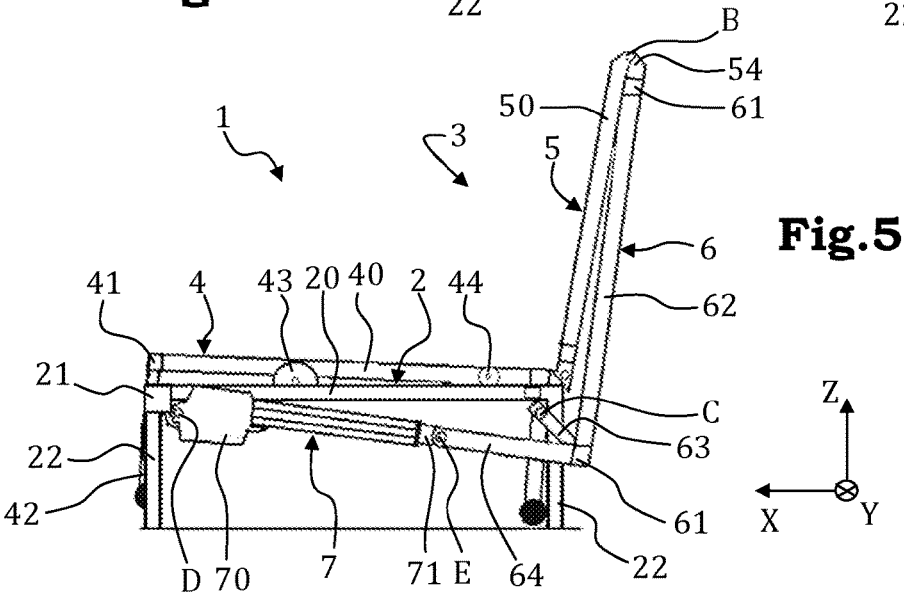
FIG. 5 is a schematic view of the sofa of FIG. 1 in a sofa configuration, in the same cross-sectional plane II-II.

The fixed structure 2 is stabilized on the ground, whereas the foldable structure 3 can be folded and unfolded between: a sofa configuration (FIGS. 5 and 6) in which the front panel 4 forms a seat, the central panel 5 forms a backrest, and the rear panel 6 is folded over the central panel 5, with the rear panel 6 behind the central panel 6; and a sleeping configuration (FIGS. 1 and 2) in which the three panels 4, 5, 6 are substantially coplanar, parallel to the horizontal plane (X, Y), to form a bed base.

The sleeping configuration, the rod 71 is extended out of the body 70 of the actuator 7, whereas in the sofa configuration, the rod 71 is retracted to inside the body 70.

In the sleeping configuration, the front panel 4 rests on the feet 42 thereof, the central beam 52 of the central panel 5 rests on the transverse beam 21 of the fixed structure 2, and the front transverse beam 61 of the rear panel 6 rests on the lateral beams 20 and central beam 23 of the fixed structure 2.

Therefore, the transition from the sleeping configuration (FIG. 2) to the sofa configuration (FIG. 5) is achieved, according to a folding movement, by controlling the actuator 7 in the direction of retraction of the rod 71, with the subsequent rolling out, with reference to FIGS. 2 to 5 and 9*a* to 9*d*: at the start of the movement (FIGS. 3 and 4), the retraction of the rod 71 concomitantly causes pivoting toward the rear of the rear panel 6 about the C-axis (the steering of the folding of the foldable structure 3 occurring at the level of this C-axis), rotating movement about the B-axis between the panels 5, 6, which corresponds to a folding movement in the direction of reunification between the two panels 5, 6, and rotating movement about the A-axis between the panels 4, 5, which leads to translation of the front panel 4 towards the rear (facilitated by the wheels 420); then (FIG. 9*a*), the rear wheels 44 roll over the top of the lateral beams 20 of the fixed structure 2 (the height and width positioning of the rear wheels 44 being provided to establish this rolling support of the rear wheels 44 on the lateral beams 20, in order to apply a force aimed at pressing the fixed structure 2 to the ground); then (FIG. 9*b*) the front wheels 43 ride on the front ramps 250 of the front supports 25 (the height and width positioning of the front wheels 43 being provided to establish this rolling support of the front wheels 43 on the front supports 25, in order to apply a force aimed at pressing the fixed structure 2 to the ground), and the rear wheels 44 may be released opposite to the lateral beams 20, as a result of the folding/unfolding mechanism, which in no way negatively affects the transfer of weight, because the front wheels 43 are well supported on the fixed structure 2; then (FIG. 9*c*) the front wheels 43 roll on the boards 251 of the front supports 25, thus maintaining the force aimed at pressing the fixed structure 2 to the ground; and finally (FIGS. 9*d* and 5) the front wheels 43 go down the rear ramps 252 of the front supports 25 and stop on the rear ramps 252, the rear wheels 44 being again supported on the lateral beams 20.

In the sofa configuration, the front wheels 43 are dimensioned and arranged so that, despite the lowering of the support point as a result of the rear ramps 252, the front wheels 43 lift up the front of the front panel 4 which forms the seat; in other words, the lateral beams 40 are no longer horizontal, but are rather inclined with the front ends thereof higher than the rear ends thereof, thus providing an improved seating comfort.

It shall be readily understood that the invention is not limited to the specific embodiment, and that variations can be considered, such as, for example, the following variations.

In one variation, the fixed structure comprises two lateral armrests, right and left, respectively, optionally connected at the rear by a transverse bar. For the embodying of the invention, the armrests have lateral beams on the respective internal faces thereof. In such a case, the front supports are provided on the inner sides of the lateral beams, and the front and rear wheels of the front panel are directed to the outside of the frame so as to cooperate with the lateral beams.

In one variation, the body of the actuator is fixed to other points of the fixed structure, and a variation with at least two synchronized actuators is conceivable.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" or "an" to modify a noun may be understood to be used for convenience and to include one, or more than one of the modified noun, unless otherwise specifically stated.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

Having described preferred embodiments of the invention it will now become apparent to those of ordinary skill in the art that other embodiments incorporating these concepts may be used. Accordingly, it is submitted that that the invention should not be limited to the described embodiments but rather should be limited only by the spirit and scope of the appended claims.

What is claimed is:

1. A convertible sofa of the perpendicular-sleeping type, said sofa comprising:

a fixed structure supporting a foldable structure which comprises three panels, namely, a central panel having two opposite sides articulated on a front panel and a rear panel, respectively, along axes of articulation parallel to a transverse direction, the rear panel comprising a rear transverse beam to which a first distal end of a pivot arm and a first distal end of a lever arm are connected, the foldable structure articulated on the fixed structure at a second distal end of the pivot arm, where the foldable structure can be folded/unfolded moving in a longitudinal direction between:

a sofa configuration in which the front panel forms a seat, the central panel forms a backrest, and the rear panel is folded over the central panel; and a sleeping configuration in which the three panels are substantially coplanar, so as to form a bed base;

said sofa further comprising a system of actuation of folding/unfolding of the foldable structure between the sofa configuration and the sleeping configuration, and vice versa; and wherein the system of actuation comprises at least one motorized cylinder actuator comprising a body within which a rod is movable in translation, where a first distal end of the actuator is articulated on the fixed structure and a second distal end of the actuator is articulated on a second distal end of the lever arm, movement of the rod causing the foldable structure to fold/unfold.

2. The convertible sofa according to claim 1, characterized by further comprising a support of the foldable structure on the fixed structure, said support providing support of the foldable structure on the fixed structure in the sofa configuration, and said support providing sliding or rolling support between the foldable structure and the fixed structure in the longitudinal direction along at least a longitudinal element of the fixed structure and/or the foldable structure so as, on one hand, to maintain the support of the foldable structure on the fixed structure during a part of the folding/unfolding, and, on the other hand, to guide the foldable structure from the sleeping configuration toward the sofa configuration.

3. The convertible sofa according to claim 2, characterized in that the support comprises:

at least one sliding or rolling support piece mounted onto one of the fixed or foldable structures; and at least one longitudinal element integrated to the other of the fixed or foldable structures, extending along the longitudinal direction and defining a surface of contact with the support piece or support pieces, the contact being maintained over a predetermined length of said longitudinal element.

4. The convertible sofa according to claim 3, characterized in that the support is distributed symmetrically along a median and longitudinal plane of the sofa, said support comprising:

at least one right support piece mounted onto one of the fixed or foldable structures and cooperating with at least one right longitudinal element integrated to the other of the fixed or foldable structures;

at least one left support piece mounted onto one of the fixed or foldable structures and cooperating with at least one left longitudinal element integrated to the other of the fixed or foldable structures.

5. The convertible sofa according to claim 3, characterized in that the support is distributed between front and rear and comprises:

at least one front support piece mounted onto one of the fixed or foldable structures and cooperating with a front surface of contact integrated to the other of the fixed or foldable structures; and at least one rear support piece mounted onto one of the fixed or foldable structures and cooperating with a rear surface of contact integrated to the other of the fixed or foldable structures;

where said front and rear support pieces are offset from one another in the longitudinal direction, and optionally said front and rear support pieces and said front and rear surfaces of contact are likewise offset from one another in the transverse direction.

6. The convertible sofa according to claim 5, characterized in that the support is configured so as, in the sofa configuration, to lift a front side of the front panel, opposite to a rear side articulated on the central panel, so that said front panel is inclined with respect to the horizontal, and to lock said sofa in a lifted configuration wherein the front side of the front panel is lifted such that the front panel is inclined with respect to the horizontal.

7. The convertible sofa according to claim 6, characterized in that the front support piece or pieces has dimensions in a vertical direction orthogonal to the longitudinal and transverse directions greater than those of the rear support piece or pieces, and the front surface or surfaces of contact have a locking ramp on which the relevant front support piece is supported in the sofa configuration, in order to ensure the locking of the sofa in the lifted configuration.

8. The convertible sofa according to claim 7, characterized in that the front surface or surfaces of contact have a board longitudinally extended on one side by the locking ramp and on the other side by a guidance ramp designed so as to guide the relevant front support piece during the folding from the sleeping configuration toward the sofa configuration.

9. The convertible sofa according to claim 3, characterized in that the support piece or pieces comprises a wheel rotatably mounted about an axis parallel to the axes of articulation.

10. The convertible sofa according to claim 2, characterized in that the support provides support of the front panel of the foldable structure on the fixed structure.

* * * * *